US005816073A

United States Patent [19]

Bardisbanyan

[11] Patent Number: 5,816,073

[45] Date of Patent: Oct. 6, 1998

[54] HINGED EARRING

[75] Inventor: Vahran Bardisbanyan, Los Angeles County, Calif.

[73] Assignee: Marquesa, Inc., Van Nuys, Calif.

[21] Appl. No.: 798,878

[22] Filed: Feb. 11, 1997

[51] Int. Cl.[6] ..... A44C 7/00

[52] U.S. Cl. ..... 63/12; 63/13; 24/616

[58] Field of Search ..... 63/12, 13; 24/499, 24/615, 616

[56] References Cited

U.S. PATENT DOCUMENTS

| | | | |
|---|---|---|---|
| 2,713,863 | 7/1955 | Handerson | 63/12 |
| 4,319,574 | 3/1982 | Sun et al. | 63/12 X |
| 4,694,664 | 9/1987 | Elsener | 63/12 |
| 4,815,180 | 3/1989 | Elsener | 24/616 |

*Primary Examiner*—Kien T. Nguyen
*Attorney, Agent, or Firm*—Levisohn, Lerner, Berger & Langsam

[57] ABSTRACT

A hinged earring possesses a way of locking the earring in either an open or a closed position. The hinge is formed between two segments of an earring and is provided with two flat surfaces. A tongue, preferably resilient, protrudes from one of the segments of the earring. When the earring is closed, the tongue engages one of the flat surfaces, and when the earring is open, the tongue engages the other of the flat surfaces. The flat surfaces are preferably adjacent, sharing a common edge. The edge makes it difficult for the earring to accidently fall open when closed or fall closed when open. When the earring is moved from open to closed or from closed to open, the edge abuts against the tongue, requiring a certain amount of force to change the position of earring segments.

7 Claims, 2 Drawing Sheets

HINGED EARRING

BACKGROUND OF THE INVENTION

1. Field of the Invention

The present invention relates to jewelry, and more specifically to a hinged earring.

2. Description of Related Art

Men and women have been piercing their ears as a fashion statement for centuries. A small hole is made in the lobe of the ear or along the outside fold of the ear by passing a needle or other sharp instrument therethrough. The hole thus made is large enough to accommodate the post or loop of an earring. An earring of the post variety has on one side an ornamental member, such as a setting for receiving a jewel or gemstone, and on the other side a straight rod or post to be inserted into the pierced hole of the ear. A clasp attaches onto the post, after it has been inserted into the pierced hole so that the earring is secured to the ear.

There exists a type of loop earring that is described in U.S. Pat. No. 4,694,664 to Elsener. This loop earring consists of two roughly semicircular ring halves which are connected at one end by a hinge. The post is mounted on one ring half and fits into a hole or aperture provided on the ring other half. The post is provided with a groove and the aperture is provided with a pawl that lockingly engages the groove on the post, and thus secures the earring closed. There is no mechanism to lock the earring in an open position. As a result, the earring is not convenient to put on or remove, as the two ring halves can move relative to one another unless the earring is locked closed.

Another conventional earring, sold by Bloomingdales, Inc., also consists of two ring halves connected at one end by a hinge. A biasing wire is provided attached to the inside of both ring halves and wrapped around the hinge. The biasing wire is resilient, and exerts a closing force on the two ring halves, pulling them towards each other. As with the Elsener earring, there is no mechanism to lock the earring in an open position. This earring is even less convenient to put on and remove than that of Elsener, as the biasing wire is constantly forcing the earring into a closed position.

Accordingly, there is a need for an earring that will remain locked closed when in a closed position but will also remain locked open when in an open position.

SUMMARY OF THE INVENTION

It is an object of the invention to provide a hinged earring that will remain locked closed when in a closed position and will remain locked open when in an open position.

It is another object of the invention to provide an earring that is easy to put on and remove.

The above and other objects are achieved by the invention, which is an earring comprising first and second body segments connected together and movable relative to each other between a first, closed position and a second, open position. A hinge is provided that connects the first and second body segments together. The earring also has a locking means for selectively locking the body segments in the open and closed positions. The locking means preferably includes two flat surfaces provided on the hinge, and a tongue that engages the flat surfaces when the earring is either open or closed. The tongue protrudes from one of the body segments, preferably disposed on the interior of that body segment pointing towards the other body segment. The tongue may be a leaf spring that presses down on the hinge.

When the earring is closed, the tongue engages one flat surface, locking the earring in the closed configuration.

When the earring is opened but is intermediate the open and closed configuration, the common edge between the two flat surfaces presses up against the tongue. When the earring is fully opened, the tongue engages the other flat surface, locking the earring in the open configuration.

DETAILED DESCRIPTION OF THE PREFERRED EMBODIMENTS

Figure 1:
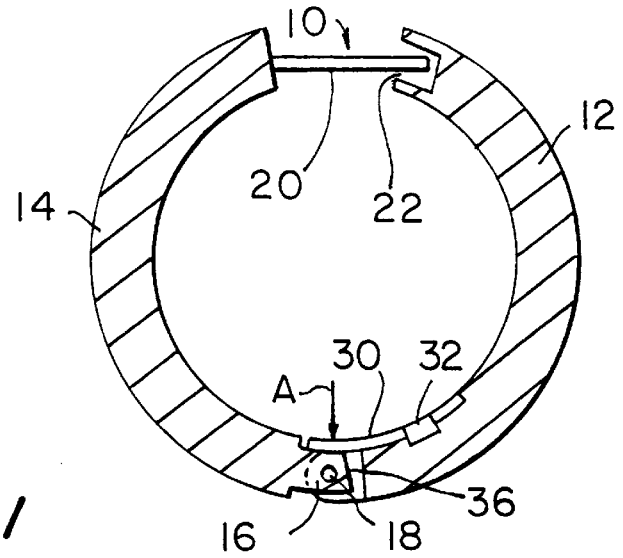
FIG. 1 is a sectional view of an embodiment of the invention in a closed position.

The invention will now be described with reference to FIGS. 1–4. Earring 10 includes two semi-circular body segments 12 and 14, which are connected together by hinge 16. Hinge 16 is formed from a protrusion 15 (see FIG. 4) of segment 14 connecting with a mating protrusion (not shown) of segment 12. Pin 18 passes through the two protrusions and allows them to rotate in typical hinge fashion. A post 20 is provided on segment 14 for passing through a perforation in an earlobe. Space 22 is formed in segment 12 for receiving post 20; alternatively, post 20 may simply pass under the free end of segment 12.

Hinge 16 (at least on protrusion 15 of hinge 16) has two flat surfaces 34 and 36 formed on an interior portion of the hinge. Flat surfaces 34 and 36 are preferably adjacent and share a common edge 38 (se FIG. 4). Tongue 30 is installed in tongue mount 32 on an interior portion of segment 12, pointing towards segment 14. Tongue 30 engages surface 34 of hinge 16 when the earring is in a closed position or configuration, and engages surface 36 when the earring is in an open position or configuration. Tongue 30 is preferably a leaf spring exerting a downward force on hinge 16.

Figure 2:
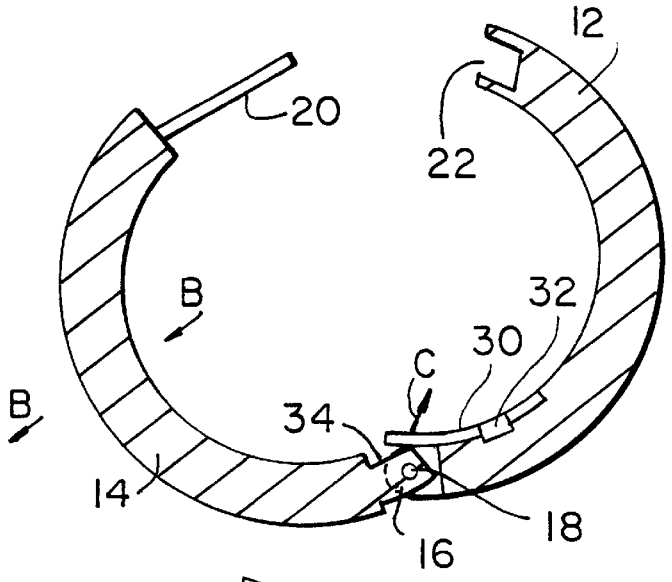
FIG. 2 is a sectional view of the embodiment of FIG. 1 intermediate a closed position and an open position.
Figure 3:
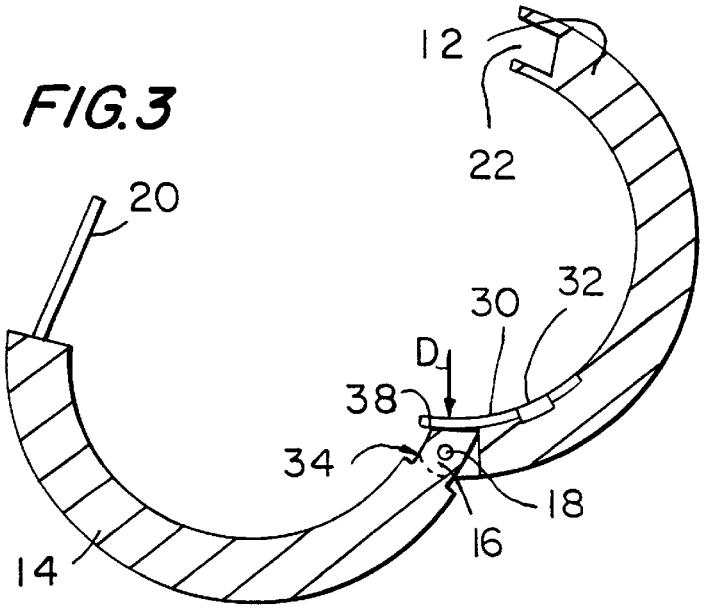
FIG. 3 is a sectional view of the embodiment of FIG. 1 in an open position.
Figure 4:
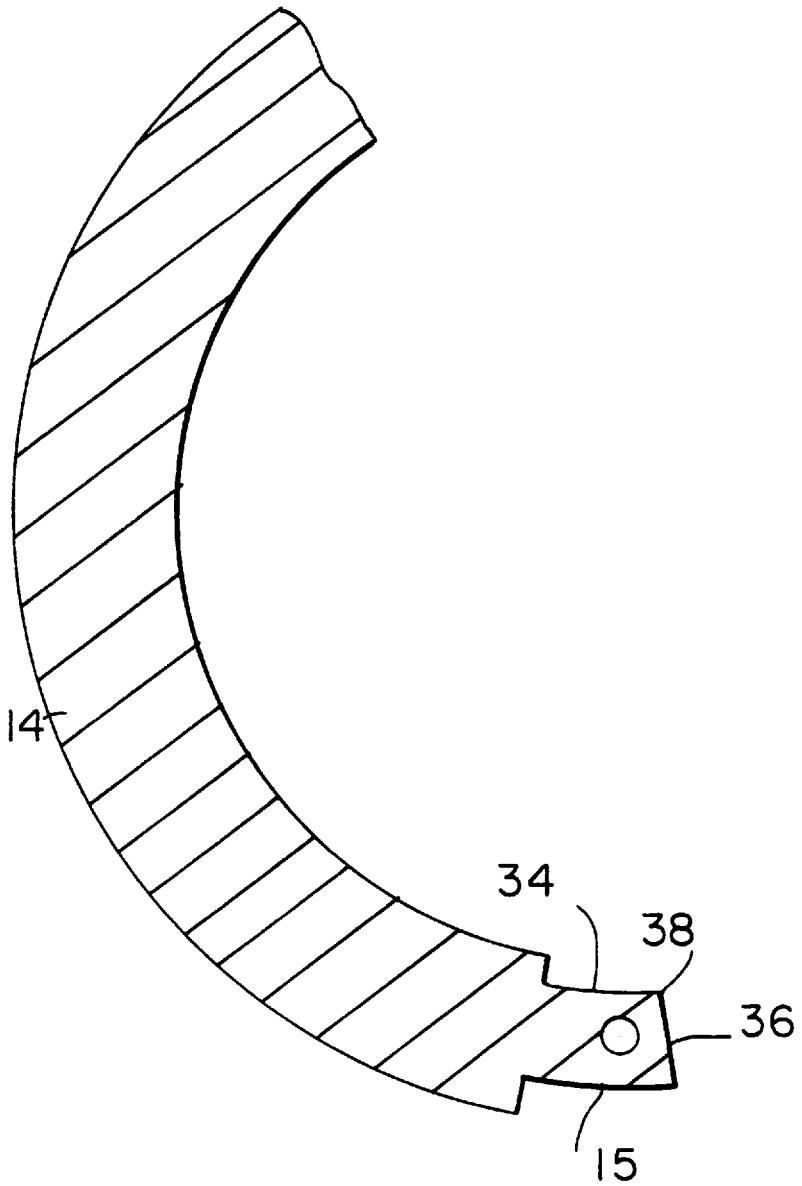
FIG. 4 is a sectional view of one of the body segments of the invention.

When the earring 10 is closed, as shown in FIG. 1, the bottom of tongue 30 presses down on surface 34 as depicted by arrow A, and keeps the earring locked in the closed position. Should a user wish to open earring 10, for the purpose of putting on or removing the earring, the user pulls segments 12 and 14 apart, and segment 14 moves as shown in FIG. 2 by arrow B (relative to segment 12). In between the closed and open positions of FIGS. 1 and 3, edge 38 swings around and pushes tongue 30 upwards, as shown by arrow C in FIG. 2. Thereafter, surface 36 is made flush with the bottom of tongue 30, and the earring 10 is locked in the open position as shown in FIG. 3. In this position, tongue 30 presses down on surface 36 in the direction of arrow D.

By providing a means for locking the earring into either the closed or the open position, the inventor has created an earring that is much simpler and easier to put on and remove from the ear lobe or the side fold of the ear. The common edge of surfaces 34 and 36 makes it difficult for the earring to accidently fall open when closed or fall closed when open. When the earring is moved from open to closed or from closed to open, the edge abuts against the tongue, requiring a certain amount of force to change the position of earring segments.

Having described the invention with regard to specific embodiments, it is to be understood that the description is not meant as a limitation such further variations or modifications may be apparent or may suggest themselves to those skilled in the art. It is intended that the present invention cover such variations and modifications as fall within the scope of the appended claims.

What is claimed is:

1. An earring, comprising:

first and second body segments connected together and movable relative to each other between a first position and a second position;

a hinge connecting said first and second body segments together; and locking means for selectively locking said body segments in said first and second positions, said locking means comprising: two flat surfaces formed on said hinge, each of said flat surfaces corresponding to one of said first and second positions; and a tongue protruding from one of said first and second body segments, said tongue being selectively engageable with said two flat surfaces of said hinge to lock said body segments selectively in one of said first and second positions at a time.

2. An earring according to claim 1, wherein said flat surfaces are adjacent and share a common edge formed on said hinge.

3. An earring according to claim 2, wherein when said body segments are moved from one of said first and second positions to the other of said first and second positions, said edge on said hinge engages said tongue and presses against said tongue.

4. An earring according to claim 2, wherein said tongue comprises a leaf spring that exerts pressure on said hinge.

5. An earring according to claim 4, wherein when said body segments are moved from one of said first and second positions to the other of said first and second positions, said edge on said hinge engages said tongue and presses against said tongue.

6. An earring according to claim 1, wherein said tongue comprises a leaf spring that exerts pressure on said hinge.

7. An earring according to claim 1, wherein said tongue is provided on an interior portion of said one of said body segments and protrudes towards the other of said body segments.

* * * * *